United States Patent [19]

Knight

[11] 4,239,407

[45] Dec. 16, 1980

[54] HARD TO REACH PLACES SPRAY CAN

[76] Inventor: Hester L. Knight, 788 Bayview Ave., Amityville, N.Y. 11701

[21] Appl. No.: 14,239

[22] Filed: Feb. 22, 1979

[51] Int. Cl.[3] ..... A46B 11/02

[52] U.S. Cl. ..... 401/190; 401/206; 401/207; 222/394; 222/464; 222/510

[58] Field of Search ..... 222/394, 510, 464; 401/190, 207, 196, 265, 266, 287, 202, 205–206; 128/251, 269, 200.23, 261, 239

[56] References Cited

U.S. PATENT DOCUMENTS

| | | | |
|---|---|---|---|
| 39086 | 6/1863 | Williams | 222/464 |
| 2,090,334 | 8/1937 | Paasche | 222/510 X |
| 2,790,190 | 4/1957 | Mastrandrea | 401/190 X |
| 3,731,682 | 5/1973 | Fielding | 128/251 X |

FOREIGN PATENT DOCUMENTS

| | | | |
|---|---|---|---|
| 202976 | 5/1939 | Switzerland | 222/394 |

*Primary Examiner*—Charles A. Marmor
*Attorney, Agent, or Firm*—Richard L. Miller

[57] ABSTRACT

An aerosol pressure can containing liquid wax for furniture, the can including interchangeable nozzles, one of which is cone shaped, another sprays sideward, and another sprays endways; and the can includes a depressible button its side for opening a dispensing valve along an outlet tube leading to the nozzle.

1 Claim, 3 Drawing Figures

HARD TO REACH PLACES SPRAY CAN

BACKGROUND OF THE INVENTION

Figure 1:
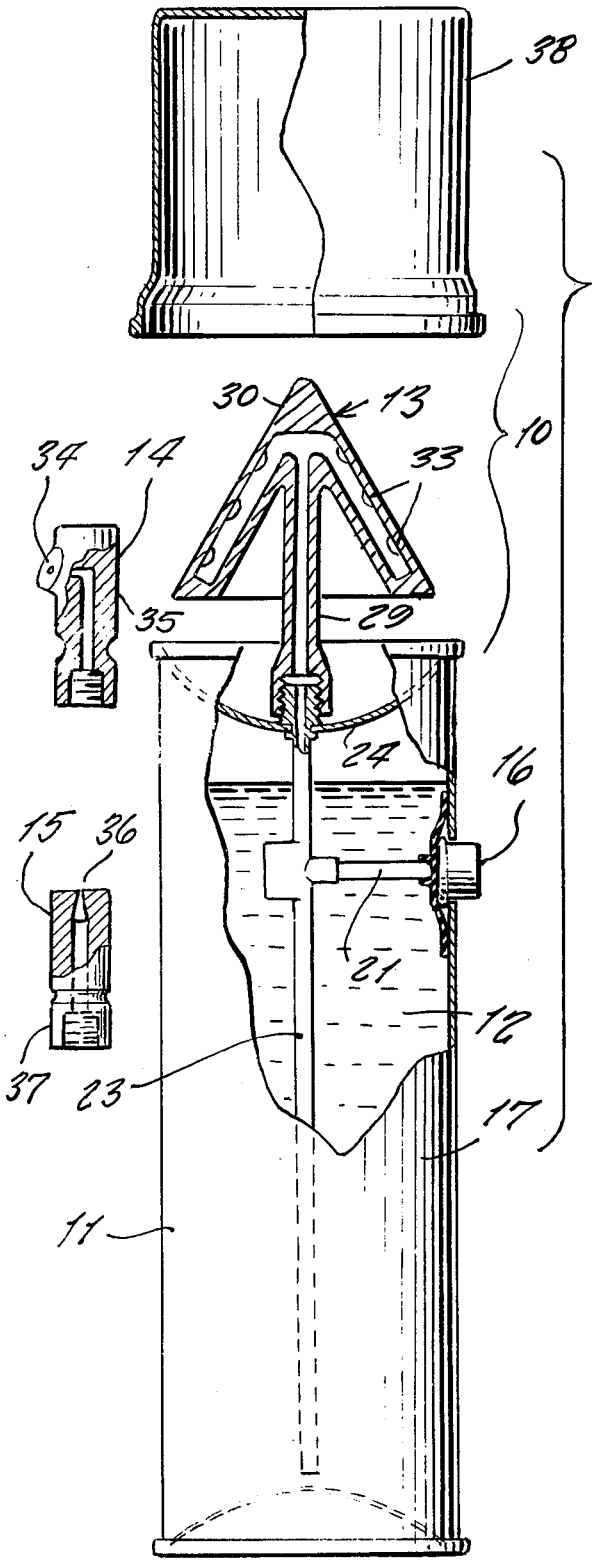

This invention relates generally to aerosol pressure cans. It is well known that spray cans have heretofore been made with a release valve being located adjacent the spray nozzle and are often made to be activated by tilting the nozzle which is not ideal as it changes a direction of the nozzle spray, so that the situation is in want of an improvement. Also hereforeto cans are not designed for access to spray into hard to get areas.

SUMMARY OF THE INVENTION

Accordingly it is a principal object of the present invention to provide an aerosol pressure can wherein the release valve is operated by a button conveniently located on a side of the can where it is convenient for a finger or thumb of a hand grasped around the can.

Another object of this invention is to provide a spray can that is designed to be capable of spraying into hard to get corners or areas.

Yet another object is to provide a spray can having interchangeable, different types of nozzles for different specific areas intended to be reached.

Still another object is to provide a spray can which is especially designed for spraying wax polish upon furniture.

Further objects of the invention will appear as the description proceeds.

To the accomplishment of the above and related objects this invention may be embodied in the form illustrated in the accompanying drawing, attention being called to the fact, however, that the drawings are illustrative only, and that changes may be made in the specific construction illustrated and described within the scope of the appended claims.

BRIEF DESCRIPTION OF THE DRAWING FIGURES

FIG. 1: is a side view partly in cross section, showing the invention incorporated with its aerosol pressure can.

Figure 2:
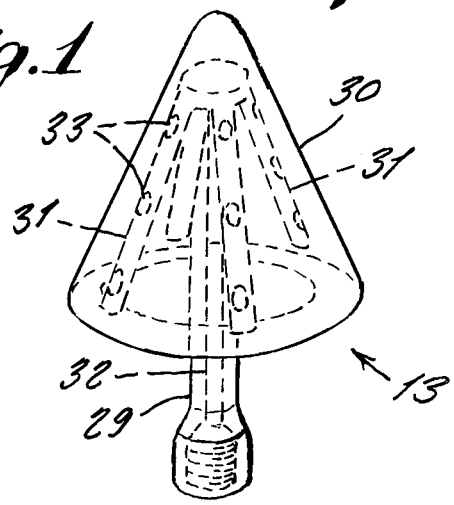

FIG. 2: is a perspective view of the spray head shown in FIG. 1.

Figure 3:
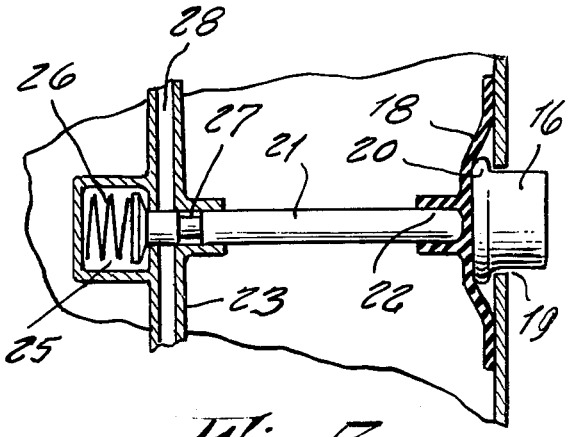

FIG. 3: is an enlarged, detailed cross sectional view of the side button mechanism.

PREFERRED EMBODIMENT OF THE INVENTION

Refering now to the drawing in greater detail, the reference numeral 10 represents a spray can according to the present invention which includes a pressurized can member 11 containing a liquid wax polish 12. As will be seen this can may be selectively fitted with any one of spray nozzles 13, 14, and 15, for directing the spray into a desired place.

The can member 11 includes a push button 16 protruding outwardly of a cyclindrical side 17 of the can member. A flexible diaphragm 18 sealed along its entire edge to an inner side of the can, bears against an inner end of the push button which protudes through a hole 19 in the can wall.

An enlarged flange 20 around an inner end of the push button prevents the push button from falling out of the can hole 19.

A stiff pin 21 fitted at one end in a pocket 22 formed on the diaphragm, is slidable at its other end through a vertical discharge tube or pipe 23 which at its upper end is sealed through a center of the can top end wall 24.

The pin end extends into a chamber 25 containing a compression coil spring 26 which bears against the pin end forcing it against the push button; the pin in this position having an annular groove 27 thereof disaligned with the pipe 23, as shown in FIG. 3.

However when the push button is depressed against the action of the spring 26, the annular groove 27 aligns with the interior opening 28 of the pipe 23, thus allowing the pressurized liquid wax to escape upwardly through the pipe outward of the can.

A upper end of the pipe 23 protudes upwardly above the can top wall, and is screw threaded so that either of spray nozzles can be interchangeably screwed thereupon.

The nozzle 13 includes a tubular stem 29 which at its upper end is integral with a conical shaped head 30 so that the nozzle is umbrella-like in appearance. The head is made of knitted sponge material and includes radially extending passages 31 therewithin that communicate with an upper end of the stem central opening 32.

A plurality of spray holes 33 along the passages 31 face in an ourwardly direction so to dispense spray radially outwardly in direction. The spray holes are embedded inside the knitted sponge material so to saturate the same during a spraying operation. The conical shape of the head permits rubbing the wax against furniture surface, and allowing the head an access inside corners or other hard-to-reach places.

Another of the nozzles 14 is tubular in shape with discharge opening 34 at a side of the body 35 thereof.

Yet another of the nozzles 15 is tubular in shape with the discharge opening 36 at an end of the body 37 thereof.

A wide mouth cap 38 snap-fits on the upper end of the can member 11 and encloses the nozzle 13 when mounted on the pipe end. The other nozzles may be stored inside the cap by means of clips formed on the cap inner side.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

I claim:

1. A hard-to-reach-places spray can, comprising in combination, an aerosol pressure can, containing a liquid for being dispensed, a dispensing pipe extending vertically outward of a top of said can, an outward end of said pipe being threaded and selectively fitted with one of a plurality of different design nozzles screwed thereupon, and a longitudinally intermediate portion of said pipe inside said can having a shut-off valve; a push-button on a side of said can pushing against one end of a pin so as to hold open said valve, said valve comprising an annular groove around said pin for selective alignment with a central opening of said pipe; and a first of said nozzles comprising an umbrella-like, conical shaped head which at its apex is integral with an upper end of a tubular stem, said head being made of a knitted sponge material, a plurality of radially extending passages inside said head, a radially inward end of said passages communicating with an upper end of a central opening of said stem, and a plurality of spray holes along said radially extending passages.

* * * * *